United States Patent [19]

Tsuji

[11] Patent Number: 4,565,226

[45] Date of Patent: Jan. 21, 1986

[54] METHOD AND APPARATUS FOR SHIFTING MAIN NOZZLES ON A FLUID-JET TYPE LOOM

[75] Inventor: Kanji Tsuji, Kanazawa, Japan

[73] Assignee: Tsudakoma Kogyo Kabushiki Kaisha, Japan

[21] Appl. No.: 655,520

[22] Filed: Oct. 1, 1984

Related U.S. Application Data

[63] Continuation of Ser. No. 346,596, Feb. 8, 1982, abandoned.

[30] Foreign Application Priority Data

Feb. 9, 1981 [JP] Japan ..... 56-018383

[51] Int. Cl.[4] ..... D03D 47/30

[52] U.S. Cl. ..... 139/435

[58] Field of Search ..... 139/429, 435, 449, 453

[56] References Cited

U.S. PATENT DOCUMENTS

| | | | |
|---|---|---|---|
| 3,482,606 | 12/1969 | Mizuno et al. | 139/435 |
| 4,070,918 | 1/1978 | Fuentes | 139/449 |
| 4,074,728 | 2/1978 | Mizuno et al. | 139/435 |
| 4,146,061 | 3/1979 | Gotoh | 139/435 |
| 4,192,357 | 3/1980 | Tanaka et al. | 139/429 |
| 4,212,330 | 7/1980 | Donk et al. | 139/435 |
| 4,326,565 | 4/1982 | Van Mullekom | 139/435 |
| 4,385,649 | 5/1983 | Sevcik | 135/435 |

*Primary Examiner*—Henry S. Jaudon

*Attorney, Agent, or Firm*—Ostrolenk, Faber, Gerb & Soffen

[57] ABSTRACT

In an alternate weaving system on a fluid-jet type loom, two or main nozzles for different yarns and combined in a vertically juxtaposed arrangement are driven for common vertical reciprocation in parallel to a vertical plane including the air guide or reed array of the loom for sequential and alternate registration at an operational position corresponding to the entrance to a weft transportation channel formed by the array, thereby allowing an as close as possible location of the main nozzles to the entrance to that fluid ejected by the main nozzles should be wholly caught into the channel for stable weft insertion purposes.

5 Claims, 11 Drawing Figures

METHOD AND APPARATUS FOR SHIFTING MAIN NOZZLES ON A FLUID-JET TYPE LOOM

This is a continuation of application Ser. No. 346,596, filed on Feb. 8, 1982 in the name of Kanji Tsuji for APPARATUS FOR SHIFTING MAIN NOZZLES ON A FLUID-JET TYPE LOOM, now abandoned.

BACKGROUND OF THE INVENTION

The present invention relates to apparatus for shifting main nozzles on a fluid-jet loom, and more particularly relates to an improvement in the main nozzle shifting system in which two or more main nozzles for weft insertion are arranged on the lathe of a fluid-jet type loom and shifted in position for the purpose of different color alternate weaving.

In the different color alternate weaving, wefts of different color have to be inserted into warp sheds in an alternate fashion. To this end, two or more sets of main nozzles, one for each weft, are provided on one end section of the lathe so that, at each weft insertion, one of the main nozzles is registered at an operative position facing the entrance to the weft transportation channel formed by an air guide or reed array arranged along the length of the lathe.

In the conventional system, this shifting in position of the main nozzle is effected by moving them horizontally in the warp direction. As later described in more detail, this mode of shifting requires movement of the main nozzle transversely of a vertical plane including the air guide or reed array and such transverse movement prevents close arrangement of the main nozzles to the air guide or reed array, while causing unstable weft transportation. The horizontal movement of the main nozzles in the warp direction further induces undesirable generation of tension or slack on the yarns caught by the main nozzle, which again mars the stable nature of the intended weft insertion.

In order to remove the above-described drawbacks inherent in the horizontal main nozzle shifting system, it is proposed in Japanese Patent Publication 55-142747, corresponding to U.S. Pat. No. 4,326,565, to shift the position of a number of main nozzles by providing them with a sort of rotary motion. In this proposal, a number of main nozzles are arranged around a common support shaft and the ejection terminals of the main nozzles are converged towards and located close to the entrance to the weft transportation channel formed by an air guide or reed array. As the support shaft rotates, ejection terminals of the main nozzles are moved along arcuate loci so that they can be alternately registered at the operative position facing the entrance to the weft transportation channel.

This prior construction, however, is accompanied with several fatal drawbacks. The converged arrangement of the main nozzle terminals naturally requires a curved construction of each main nozzle and, accordingly, a curved path of travel for the yarn through the main nozzle. Increased frictional resistance on the yarn caused by the curved construction requires higher pressure of the weft transporting jet fluid, and causes generation of fluffs on the yarn or, in the worst case, breakage of the yarn being processed.

Further, attention should be directed to the point that the ejection terminals of the main nozzles are moved along the arcuate loci but not along any straight locus. In order that the weft transporting jet-fluid ejected by each main nozzle can be fully received in the weft transportation channel, the direction of the main nozzle terminal should precisely meet that of the weft transportation channel. This means that registration of each main nozzle at the above-described operational position must be precisely timed to ejection of the jet fluid. Even a slight time slip in the registration of the main nozzles leads to ejection of the jet fluid off the entrance to the weft transportation channel while resulting in poor driving force for weft transportation. In order to avoid this trouble while allowing the ejection terminals to move along the above described arcuate loci, extremely subtle adjustment of the main nozzle shifting system and its operation is required, which is almost infeasible without intensive time consumption and highly trained labor for maintenance.

SUMMARY OF THE INVENTION

The primary object of the present invention is to provide a main nozzle shifting system which allows an arrangement of main nozzles quite close to the entrance to the weft transportation channel for full utilization of weft transportation energy possessed by the jet fluid ejected from the main nozzles, thereby assuring highly stable weft transportation.

It is the other object of the present invention to enable such an ideal arrangement of the main nozzles without enfeebling the construction of the air guide or reed array.

It is a further object of the present invention to provide a main nozzle shifting system which assures precisely designed and time registration of the main nozzles at the operative position without causing any damage to the yarns including breakages and without requiring any subtle, time-consuming adjustment of the system and its operation.

In accordance with the basic concept of the present invention, two or more sets of main nozzles are juxtaposed in the vertical direction while extending in front of the outermost vertical side bar and, at every weft insertion, one of the main nozzles is registered at the operative position by driving the main nozzles for substantially straight vertical movement, while maintaining their juxtaposed arrangement, substantially in parallel to the plane including the air guide or reed array.

Although the following description is directed to the case in which two color alternate weaving is employed, it shall be well understood by ones skilled in the art that the above-described basic concept of the present invention can be readily applied to cases wherein three or more sets yarns of different colors are to be inserted.

DESCRIPTION OF THE PREFERRED EMBODIMENTS

One typical mode of a conventional main nozzle shifting system for two color alternate weaving is illustrated in FIGS. 1A through 2B, in which the loom is provided with two sets of main nozzles N1 and N2 arranged on one end section of the lathe. The main nozzles N1 and N2 are juxtaposed in the warp direction and are driven for horizontal movement in the warp direction across the vertical plane including the air guide or reed array AGR. Yarns Y1 and Y2 of different colors are led to the main nozzles N1 and N2 via associated yarn guides G1 and G2, respectively. For successful weft insertion, each nozzle has to be precisely registered position with the entrance to the weft transportation channel AGC formed by air guide or reed array AGR.

Figure 1A:
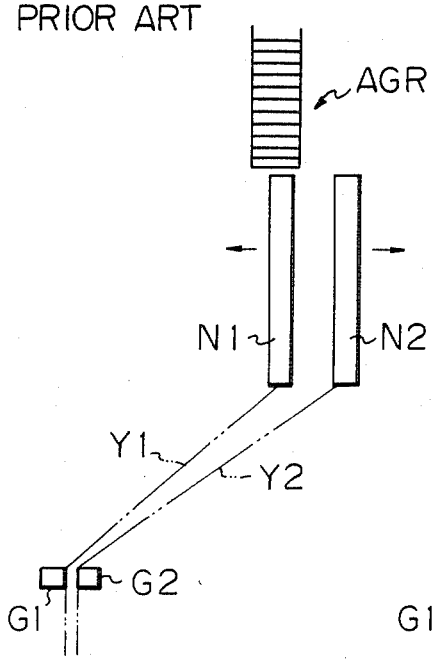
Fig. 1A PRIOR ART
FIGS. 1A and 2A are simplified plan views showing one typical mode of the conventional main nozzle shifting system.
Figure 1B:
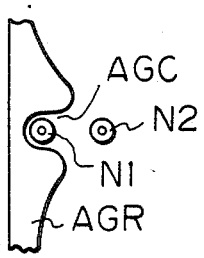
Fig. 1B PRIOR ART
FIGS. 1B and 2B are simplified side views showing the above-described mode of the conventional main nozzle shifting system.

Under the condition shown in FIGS. 1A and 1B, the first main nozzle N1 is registered with the entrance to the weft transportation channel AGC for the current insertion of the first yarn Y1. At this moment, the second main nozzle N2 in its dwell is located on the front side of the plane including the air guide or reed array AGR.

Figure 2A:
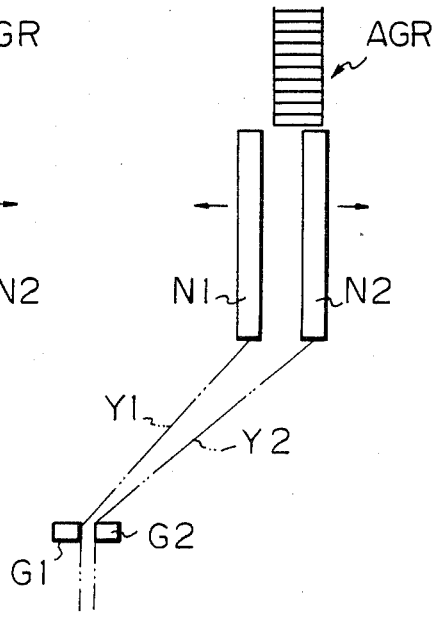
Fig. 2A PRIOR ART
Figure 2B:
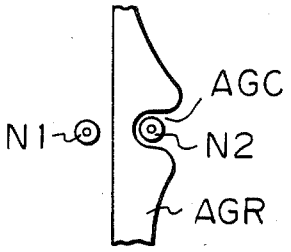
Fig. 2B PRIOR ART

After insertion of the first yarn Y1 is over, the main nozzles N1 and N2 both move horizontally rearwards so that the second main nozzle N2 should be registered with the entrance to the weft transportation channel AGC for the next insertion of the second yarn Y2, as shown in FIGS. 2A and 2B. Under this condition, the first main nozzle N1 in its dwell is located on the rear side of the plane including the air guide or reed array AGR.

After insertion of the second yarn Y2 is over, the main nozzles N1 and N2 both move horizontally forwards so that the first main nozzle N1 resumes the operative position in alignment with the entrance to the weft transportation channel AGC.

In either shifting motion, one of the main nozzles N1 and N2 has to move horizontally transverse the plane including the air guide or reed array AGR. In order to enable such a transverse movement of the main nozzles during the shifting motion, both main nozzles N1 and N2 have to be located outside the outermost vertical side bar of the reed. As a consequence, the ejection terminal of each main nozzle has to be located remote from the entrance to the weft transportation channel located on the inner side of the outermost vertical side bar of the reed, while leaving a relatively large gap between the ejection terminal and the entrance. Presence of such a large gap allows easy divergence of the weft transporting jet fluid just after ejection from the main nozzle and the fluid cannot effectively embrace the weft to be transported. This naturally eventuates in unstable weft transportation which is liable to cause unsuccessful weft insertion. In order to obviate this trouble, the ejection terminal of the main nozzle has to be located quite close to the entrance to the weft transportation channel which requires omission of the outermost portion of the reed. This inevitably enfeebles the construction of the entire air guide or reed array AGR.

The above-described conventional main nozzle horizontal shifting motion is accompanied with a further drawback. The length of the yarn section extending between the fixed yarn guide and the mobile main nozzle varies depending on the horizontal position of the main nozzle in charge of that yarn. Take the first main nozzle N1 for example, the length of the section of the first yarn Y1 for the position shown in FIG. 1A is longer than that shown in FIG. 2A. As a consequence, slack is generated on the yarn Y1 at shift from FIG. 1A to FIG. 2A, whereas tension is generated at shift from FIG. 2A to FIG. 1A. Such alternate generation of tension and slack seriously disturbs stability of the weft insertion.

Figure 3A:
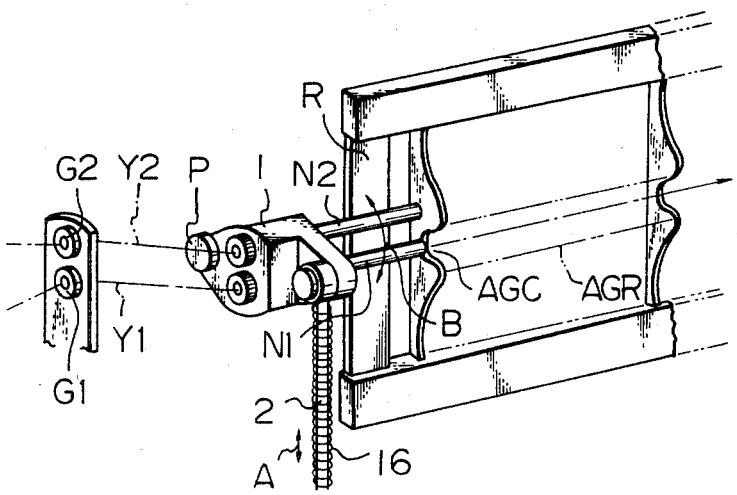
FIGS. 3A is a perspective view of one embodiment of the main nozzle shifting system in accordance with the present invention.
Figure 3B:
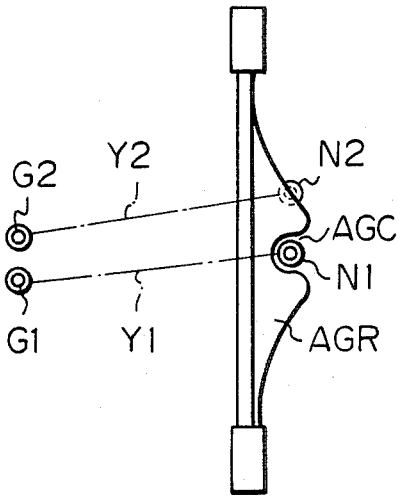
FIGS. 3B and 3C are simplified side views showing the mode of the main nozzle shifting system shown in FIG. 3A.
Figure 3C:
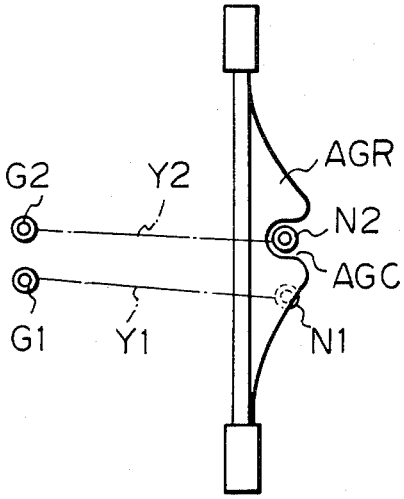

One embodiment of the main nozzle shifting system in accordance with the present invention is shown in FIGS. 3A through 3C, in which a main nozzle holder 1 is pivotable about a horizontal pivot P which extend in the weft direction and is secured to an appropriate section of the lathe close to the outermost portion of the reed. A pair of main nozzles N1 and N2 are juxtaposed in the vertical direction and are directed in the weft direction on the main nozzle holder 1. The main nozzles N1 and N2 extend in front of the outermost vertical side of the reed RD and terminals at a position very close to the entrance to the weft transportation channel AGC. The yarns Y1 and Y2 are led to the respective main nozzles N1 and N2 via yarn guides G1 and G2. A front short extension of the main nozzle holder 1 is pivoted to the top end of a shifter rod 2. As the shifter rod 2 moves as shown with an arrow A, the main nozzle holder 1 is driven for a swing motion about the fixed pivot P as shown with an arrow B in order to take two positions. As shown in FIG. 3A, the pivot P is located as close as possible to the positions of the main nozzles N1 and N2 in order to provide them with the minimum but necessary movement at shifting. Because of this close arrangement, the main nozzles N1 and N2 practically follow substantially straight loci in their vertical movement, although they swing about the pivot P in this embodiment.

When the main nozzle holder 1 assumes the first position, the first main nozzle N1 is registered at the operative position closely facing to the entrance to the weft transportation channel AGC formed by the air guide or reed array AGR as shown in FIG. 3B so that the first yarn Y1 should be subjected to weft insertion. At this moment of the process, the second main nozzle N2 in its dwell is located above the level of the weft transportation channel AGC. Whereas, when the main nozzle holder 1 assumes the second position, the second main nozzle N2 is registered at the operative position closely facing the weft transportation channel AGC as shown in FIG. 3C so that the second yarn Y2 should be subjected to weft insertion. At this moment of the process, the first main nozzles N1 in its dwell is located below the level of the weft transportation channel AGC. In the manner described above, two color alternate weaving is carried out in accordance with the present invention.

Figure 4:
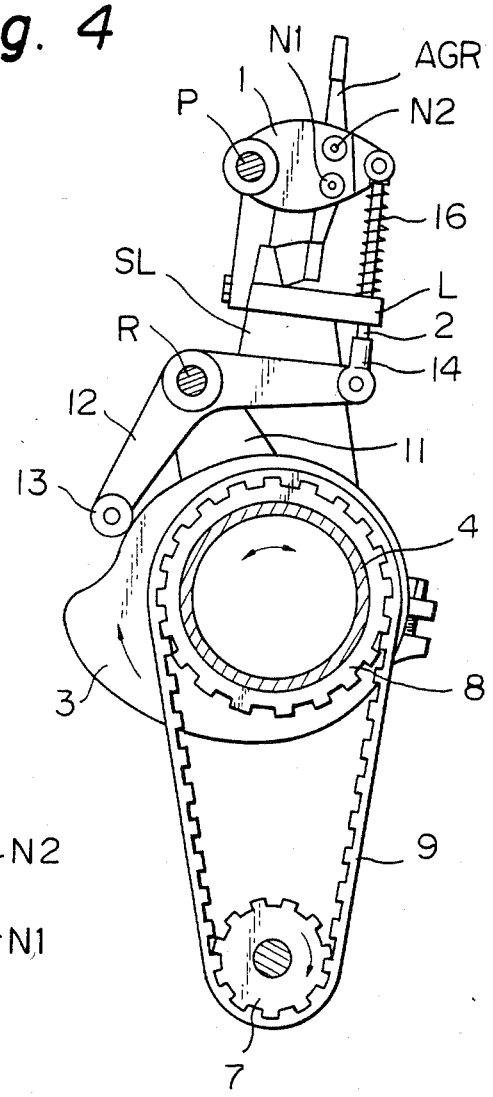
FIG. 4 is a side view of one embodiment of the apparatus for shifting main nozzles in accordance with the present invention.

One embodiment of the apparatus for causing the above-described vertical shifting of the main nozzles is shown in FIG. 4, in which the apparatus includes a cam 3 rotatably mounted to the rocking shaft 4 of the loom. The cam 3 is operationally coupled to the main shaft 6 of the loom by means of intermediate pulleys 7 and 8 and a belt 9 so that two complete revolutions of the main shaft 6 should cause corresponding one complete revolutions of the cam 3. It should be appreciated that rotation of the cam 3 is independent of rocking motion of the rocking shaft 4 since the cam 3 is rotatably mounted to the rocking shaft 4 by means of the appropriate bearing construction not shown. The rocking shaft 4 further securely carries a bracket 11 extending upwards and provided with a pivot R at its top end. An inverted L-shaped lever 12 is swingably mounted at its apex to the pivot R on the bracket 11. One end of the lever 12 rotably carries a cam follower 13 in contact with the periphery of the cam 3 on the rocking shaft 4 whereas the other end of the lever 12 is pivoted to the lower end of the shifter rod 2 by means of a joint block 14. The shifter rod 2 extends idly through the lathe L of the loom and a compression spring 16 is interposed between the top end of the shifter rod 2 and the lathe L so that the cam follower 13 should always be kept in resilient pressure contact with the periphery of the cam 3 on the rocking shaft 4. The lathe L is securedly mounted to the rocking shaft 4 by means of the slay SL.

As the rocking shaft 4 rockes, the lever 12 and the lathe L with the main nozzle holder 1 and the air guide or reed array AGR swing about the axis of the rocking shaft 4. Although the cam follower 13 travels on the periphery of the cam 3 upon this swing motion of the lever 12 about the axis of the rocking shaft 4, the cam 3 causes no swing motion of the lever 12 about the pivot R since the cam 3 is mounted to the rocking shaft 4 so that this travel of the cam follower 13 covers the dwell section of the cam 3 only.

Under the condition shown in FIG. 4, the cam follower 13 is located on the dwell section of the cam 3 and the first main nozzle N1 is registered at the operative position closely facing the entrance to the weft transportation channel AGC as shown in FIG. 3B. As described already, the second main nozzle N2 is located above the level of the weft transportation channel AGC at this moment of the process. As the cam follower 13 comes in contact with the raised section of the cam 3, the lever 12 swings clockwise in the drawing in order to pull down the shifter rod 2 against repulsion of the compression spring 16. Thereupon the main nozzle holder 1 swings downwards about the pivot P in order to register the second main nozzle N2 at the operative position closely facing the entrance to the weft transportation channel AGC as shown in FIG. 3C, and moves the first main nozzle N1 to the stand-by position below the level of the weft transportation channel AGC.

When the shifting apparatus in accordance with the present invention is employed, it is possible to use main nozzles of a straight construction which provides a straight path of travel for the yarn to be processed. This assures reduced frictional resistance against passage of the yarn through the nozzle with reduced chance of damage on the yarn when compared with the construction of the above-described Japanese Patent Opening Sho. 55-142747, corresponding to U.S. Pat. No. 4,326,565. Further, since the ejection terminals of the main nozzles are driven for vertical movement along substantially straight loci at shifting, registration of each main nozzle at the operation position can easily be timed to ejection of the jet fluid without need for subtle adjustment of the shifting system.

As described already, the cam follower 13 performs two modes of travel on the periphery of the cam 3, one being caused by swing motion of the lever 12 about the axis of the rocking shaft 4 and the other by rotation of the cam 3 itself. Further, the distance between the axis of the rocking shaft 4 and the air guide or reed array AGR is in general designed very short on high speed fluid-jet type looms in order to minimize the undesirable influence of inertia moment. Partly due to this combined motion of the cam follower 13 and partly due to the relatively short distance between the axis of the rocking shaft 4 and the air guide or reed array AGR, the relative speed between the cam follower 13 and the cam 3 significantly lowers at a certain moment in one complete revolution of the main shaft 6 of the loom. This necessitates corresponding abrupt rise in contour of the cam 3 and, depending on the design factors, presence of such an abrupt rise in cam contour impose malign influences on smooth running of the loom, in particular of the high speed fluid-jet type loom. For example, in an extreme case in which the cam 3 performs one complete revolution per four complete revolutions of the main shaft 6 of the loom, the above-described relative speed between the cam follower 13 and the cam 3 becomes, depending on the condition, about zero or negative. In such a case, it is next to impossible to properly design the cam profile.

Figure 5A:
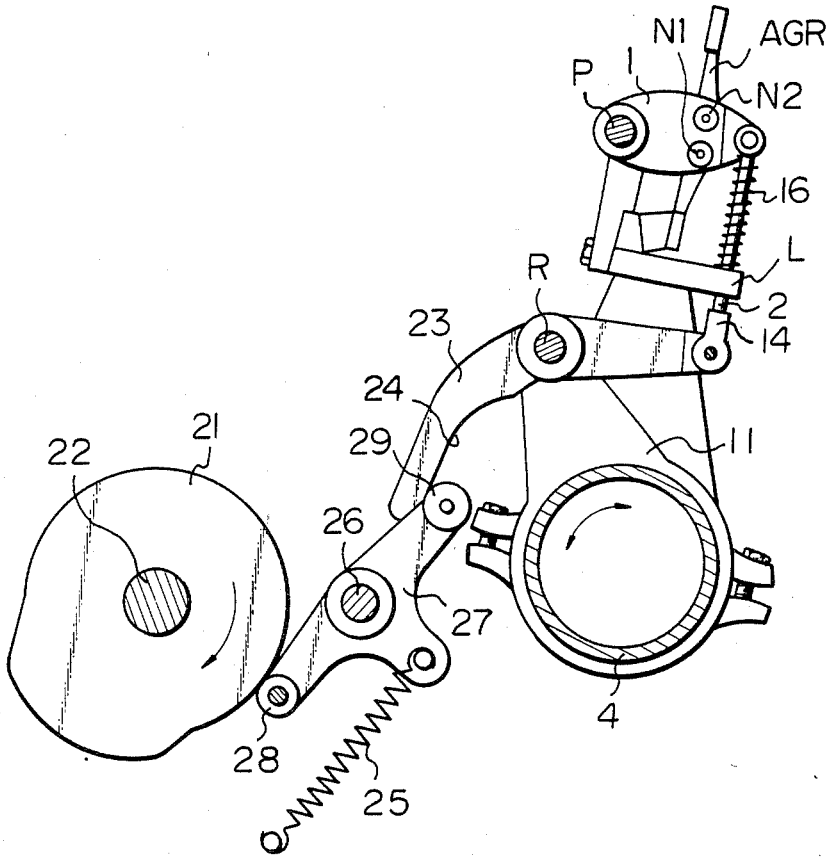
FIGS. 5A and 5B are side views of another embodiment of the apparatus for shifting main nozzles in accordance with the present invention in different operative positions.
Figure 5B:
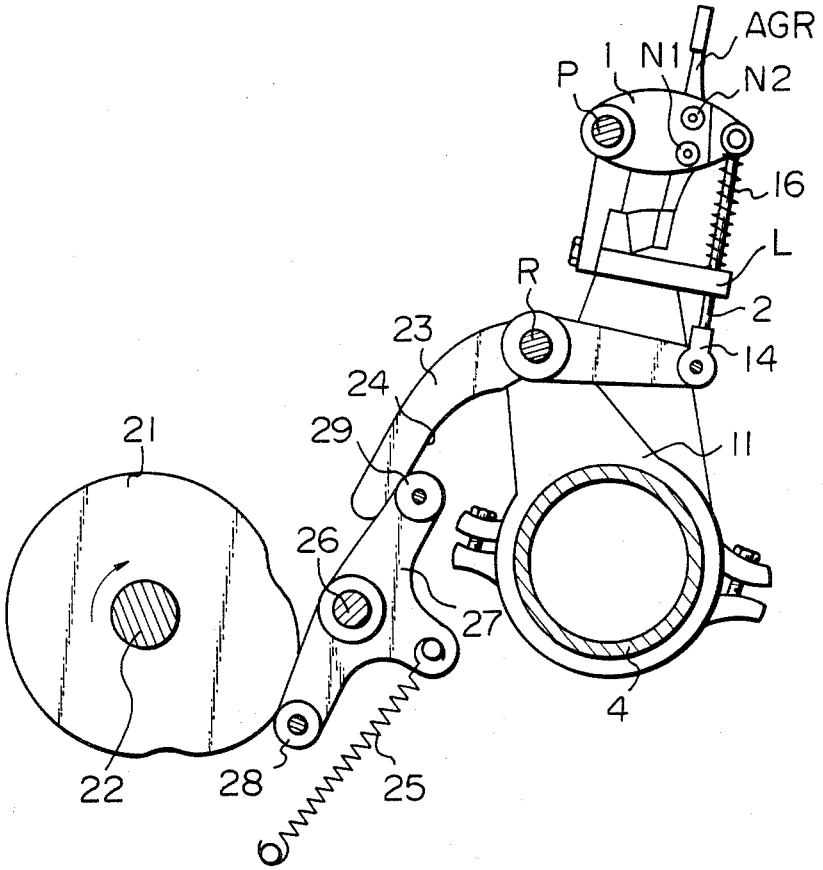

A modified embodiment of the apparatus in accordance with the present invention is shown in FIGS. 5A and 5B, which assures smooth running of the high speed fluid-jet type loom with any design factors. Here, elements substantially common in construction and operation to those in the embodiment shown in FIG. 4 are indicated with common reference symbols.

In the case of this embodiment, a cam 21 for causing the main nozzle shifting motion is rotatably mounted to a separate horizontal shaft 22 extending in parallel to the rocking shaft 4 and, though not shown in the drawings, operationally coupled to the main shaft 6 of the loom in a known manner so that the shaft 22 is driven for one complete revolution when the main shaft 6 perform two complete revolutions.

As in the foregoing embodiment, the rocking shaft 4 securely carries a radial bracket 11 which extends upwards and carries a pivot R at its top end. An inverted L-shaped lever 23 is swingably mounted at its apex to the pivot R on the radial bracket 11. The front end of this lever 23 is pivoted to the lower end of the shifter rod 2 by means of the joint block 14 whereas the other end section of this lever 23 is provided with a bottom slide 24.

A horizontal shaft 26 is fixed to the framework of the loom at a position between the cam shaft 22 and the rocking shaft 4 in parallel to these shafts. A trifurcated lever 27 is pivoted at its apex to the above-described fixed horizontal shaft 26. The rear branch of this lever 27 rotatably carries a cam follower 28 in contact with the periphery of the cam 21, the front branch of this lever 27 rotatably carries a roll 29, and the lower branch of this lever 27 carries a pin. A tension spring 25 is interposed between this pin and another pin fixed to the framework of the loom so that the cam follower 28 should always be kept in resilient pressure contact with the periphery of the cam 21. The bottom slide 24 of the lever 23 is defined by an imaginary cylindrical plane having its center axis on the the axis of the rocking shaft 4.

In the situation shown in FIG. 5A, the cam follower 28 is in contact with the dwell section of the cam 21 and the first main nozzle N1 is registered at the operative position closely facing the entrance to the weft transportation channel AGC for ejection of the first yarn Y1 as shown in FIG. 3B. At this moment of the process, the second main nozzle N2 in its dwell is located above the level of the weft transportation channel AGC.

When the situation shifts from that in FIG. 5A to that in FIG. 5B, the cam follower 28 comes in contact with the raised section of the cam 21, the trifurcated lever 27 swings counterclockwise about the horizontal shaft 26 against the force by the tension spring 25, and the lever 23 swings clockwise about the pivot R on the bracket 11. The roll 29 on the lever 27 travels along the slide bottom 24 of the lever 23 during this swing motion of the latter. As a consequence, the shifter lever 2 is pulled down against the repulsion of the compression spring 16 and the main nozzle holder 1 swings downwards about the pivot P so that the second main nozzle N2 should now be registered at the operative position closely facing the entrance to the weft transportation channel AGC for ejection of the second yarn Y2 as shown in FIG. 3C. At this moment of the process, the first main nozzle N1 is located at the stand-by position below the level of the weft transportation channel AGC.

Conversely, when the situation shifts from that in FIG. 5B to that in FIG. 5A, the cam follower 28 comes in contact with the dwell section of the cam 21, the trifurcated lever 27 swings clockwise about the horizontal shaft 26 due to the force of the tension spring 25, and the lever 23 swings counterclockwise about the pivot R due to the repulsion of the compression spring 16. During this swing motion, the roll 29 on the lever 27 again travels along the slide bettom 24 on the lever 23. As a result, the shifter rod 2 lifts and the main nozzle holder 1 is driven for an upward swing motion so that the first main nozzle N1 resumes the operative position closely facing the entrance to the weft transportation channel AGC. The second main nozzle N2 is brought to the initial stand-by position for dwell.

It should be recalled that the roll 29 on the lever 27 reciprocates along the arcuate slide bottom 24 on the lever 23 when the situation shfits between those shown in FIGS. 5A and 5B, and the curvature of the slide bottom 24 is defined by the imaginary cylindrical plane having its center axis on the axis of the rocking shaft 4. Thanks to this specified curvature of the bottom slide 24, the lever 23 can be located on a concentric circle with respect to the axis of the rocking shaft 4, and this arrangement minimizes the magnitude of an impulsive torque acting on the lever 23 when the direction of its swing motion reverses. Even with this arrangement, however, the center axis of the slide bottom 24 moves off the axis of the rocking shaft 4 when the lever 23 is swung by the roll 29 on the trifurcated lever 27. This indicates the fact that the lever 23 performs a small swing motion when the roll 29 comes to a standstill at a certain point. This small swing motion of the lever 23, however, forms no trouble in practice. Further, when required, such a small swing motion of the lever 23 can be avoided by application of appropriate adjustment to the cam profile.

Figure 6:
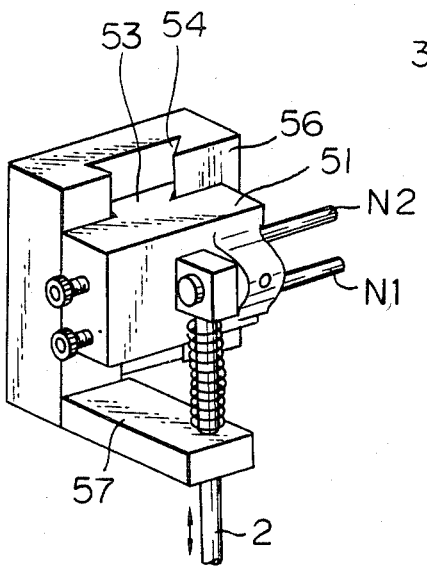
FIG. 6 is a perspective view of the other embodiment of the main nozzle shifting system in accordance with the present invention.

In the case of the foregoing embodiments, the main nozzle holder 1 is driven for a vertical movement which is substantially straight but includes a slight swing motion about a pivot P taken on the Lathe L for shifting of the main nozzles N1 and N2. As a consequence, the main nozzles N1 and N2 are forced to move along arcuate loci, admittedly loci with very minimized curvatures. In order to avoid any inconvenience to be caused by the arcuate travel of the main nozzles for shifting purposes, a further embodiment shown in FIG. 6 drives the main nozzle holder for an exactly straight vertical movement.

More specifically, the apparatus includes a main nozzle holder 51 to which a pair of main nozzles N1 and N2 are mounted in a vertically juxtaposed arrangement while extending in the weft direction in front of the outermost thick and sturdy reed. A front extension 52 of the main nozzle holder 51 is coupled to the top end of the shifter rod 2. The main nozzle holder 51 is further provided with a vertically elongated rear projection 53 which is slidably received in a vertical guide groove 54 formed in the front face of a bracket 56. This bracket 56 is secured to a base plate 57 on the lathe of the loom. As the shifter rod 2 moves in the vertical direction, the main nozzle holder 51 reciprocates in the vertical direction along the guide groove 54 in the bracket 56 so that the main nozzles N1 and N2 travel along straight vertical loci.

As a substitute for the construction shown in FIGS. 4, 5A and 5B, the shifter rod 2 may be operationally coupled to the Jackard or Dabby mechanism by means of appropriate interconnecting links.

Further, in the case of the embodiments shown in FIGS. 3, 4, 5A and 5B, the main nozzle holder is coupled at its rear end to the horizontal pivot and at its front end to the cam driving system. In an alternative, however, the connection can be reversed. In a further alternative, the main nozzle holder may be coupled about the middle of its body to the horizontal pivot.

The cams in the illustrated embodiments are operationally coupled to the main shaft of the loom in such a manner that two complete revolutions of the main shaft should cause one complete revolution of the cams. This ratio in revolutions, however, can be changed depending on the condition of the weaving process to be practiced.

In accordance with the present invention, the main nozzles are driven for a shifting motion in the vertical direction along substantially straight loci in parallel to the vertical plane including the air guide or reed array. Such vertical shifting mode allows the main nozzle to extend in front of the outermost thick and sturdy reed RD as shown in FIG. 3A to positions very close to the air guide or reed array AGR. Further, since the position of the main nozzles is always kept in parallel to the vertical plane including the air guide or reed array AGR, the jet-fluid ejected by the main nozzles can be correctly directed into the weft transportation channel AGC, thereby assuring high weft transportation energy.

I claim:

1. Apparatus for shifting main nozzles on a fluid-jet loom on which different yarns are sequentially and alternately subjected to weft insertion along a weft direction, said loom incluidng a weft transportation channel which extends along said weft direction and which has an entrance end, said apparatus comprising:

a main nozzle holder arranged on said lathe and movable with respect to said weft transportation channel in a plane lying generally parallel to said weft direction, said main nozzle holder having front and rear ends, said rear end being coupled to a horizontal pivot extending in said weft direction;

a plurality of linear main nozzles mounted to said main nozzle holder is vertically juxtaposed arrangement in front of said entrance end of said weft transportation channel and extending in parallel to said weft direction;

a vertically extending shifter rod having an upper end privoted to said front end of said main nozzle holder and a lower end;

a first horizontal shaft extending in parallel to a rocking shaft of said loom and operationally coupled to a main shaft of said loom;

a cam secured on said first horizontal shaft;

a radially extending bracket secured to said rocking shaft;

a first bifurcated lever pivoted at its apex to said bracket, one arm of said first bifurcated lever being provided with a slide bottom having a curvature concentric with said rocking shaft, and another arm of said first bifurcated lever being pivoted to said lower end of said shifter rod;

a second horizontal shaft arranged in parallel to and between said first horizontal shaft and said rocking shaft; and a second bifurcated lever pivoted at its apex to said second horizontal shaft, one end of said second bifurcated lever being provided with a cam follower kept in resilient pressure contact with said cam, and another end of said second bifurcated lever being provided with a roll in contact with said slide bottom on said first bifurcated lever.

2. Apparatus for shifting main nozzles on a fluid-jet loom on which different yarns are sequentially and alternatively subjected to a weft insertion along a weft direction, said loom including a lathe and a weft transportation channel which extends along said weft direction and which has an entrance end, said apparatus comprising:

a bracket mounted on said lathe and having a straight vertical groove formed therein;

a main nozzle holder in sliding engagement with said straight vertical groove formed in said bracket such that said main nozzle holder is movable in a vertical direction in a plane lying perpendicular to said weft direction;

means for reciprocating said main nozzle holder along said vertical direction; and a plurality of linear main nozzles mounted on said main nozzle holder in a vertically juxtaposed arrangement in front of said entrance end of said weft transportation channel and extending in parallel to said weft direction such that individual ones of said main nozzles are moved adjacent to said entrance end of said transportation channel as said nozzle holder is moved back and forth along said vertical direction.

3. Apparatus as claimed in claim 2 in which said reciprocating means includes:

a vertically extending shifter rod pivoted at a top end thereof to said main nozzle holder;

a cam rotatably mounted to a rocking shaft of said loom;

means for operationally coupling said cam to a main shaft of said loom; and means for transmitting motion of said cam to said shifter rod.

4. Apparatus as claimed in claim 3 in which said transmitting means includes:

a radially extending bracket secured to said rocking shaft and provided with a pivot;

a bifurcated lever mounted at its apex to said pivot on said radial bracket, one end of said bifurcated lever being provided with a cam follower which is in slidable contact with said cam and the other end of said bifurcated lever being pivoted to a lower end of said shifter rod; and means for causing constant resilient pressure contact between said cam and said cam follower.

5. Apparatus as claimed in claim 2 in which said driving means includes:

a vertically extending shifter rod having a top end and a lower end being pivoted at its said top end to said main nozzle holder;

a first horizontal shaft extending in parallel to a rocking shaft of said loom and operationally coupled to a main shaft of said loom;

a cam secured to said first horizontal shaft;

a radially extending bracket secured to said rocking shaft;

a first bifurcated lever pivoted at its apex to said bracket, one arm of said first lever being provided with a slide bottom having a curvature concentric with said rocking shaft, and another arm pivoted to a lower end of said shifter rod;

a second horizontal shaft arranged in parallel to and between said first horizontal shaft and said rocking shaft;

a second bifurcated lever pivoted to said second horizontal shaft, said second lever including one end provided with a cam follower, said second lever including another end provided with a roll in contact with said slide bottom on said first bifurcated lever; and means for biasing said cam follower into resilient pressure contact with said cam.

* * * * *